US005706024A

United States Patent [19]

Park

[11] Patent Number: 5,706,024

[45] Date of Patent: Jan. 6, 1998

[54] DRIVING CIRCUIT FOR LIQUID CRYSTAL DISPLAY

[75] Inventor: Seung Woo Park, Seoul, Rep. of Korea

[73] Assignee: LG Semicon, Co., Ltd., Chungcheongbuk-do, Rep. of Korea

[21] Appl. No.: 510,234

[22] Filed: Aug. 2, 1995

[51] Int. Cl.[6] ..... G09G 3/36

[52] U.S. Cl. ..... 345/96

[58] Field of Search ..... 340/166, 825.52; 345/94, 96, 209

[56] References Cited

U.S. PATENT DOCUMENTS

| | | | |
|---|---|---|---|
| 3,654,606 | 4/1972 | Marlowe et al. | 340/166 |
| 3,833,832 | 9/1974 | Fein et al. | 345/37 |
| 4,675,667 | 6/1987 | Nakamura et al. | 345/96 X |
| 4,714,921 | 12/1987 | Kanno et al. | 345/96 X |
| 4,734,692 | 3/1988 | Hosono et al. | 345/96 |
| 4,789,223 | 12/1988 | Kasahara et al. | 345/96 X |
| 4,860,006 | 8/1989 | Barall | 340/825.52 |
| 4,906,984 | 3/1990 | Takeda et al. | 345/96 X |
| 5,041,823 | 8/1991 | Johnson et al. | 345/94 |
| 5,105,187 | 4/1992 | Plus et al. | 345/96 X |
| 5,117,298 | 5/1992 | Hirai | 345/96 X |
| 5,184,118 | 2/1993 | Yamazaki | 345/96 |
| 5,561,441 | 10/1996 | Hamano | 345/96 X |

FOREIGN PATENT DOCUMENTS

| | | |
|---|---|---|
| 63-15227 | 1/1988 | Japan . |
| 59-119328 | 7/1994 | Japan . |
| 62-71932 | 4/1997 | Japan . |

OTHER PUBLICATIONS

Yasuhiro Nasu et al., "Color LCD for Character and TV Display Addressed by Self-Aligned a-Si:H TFT", SID 86 Digest, pp. 289-292.

F. Morin, "Electrooptical Performance of a TFT-Addressed TNLC Panel".

*Primary Examiner*—Mark R. Powell

[57] ABSTRACT

A circuit for driving a liquid crystal display including an inverted voltage supplying part for supplying additional inverted power to the liquid crystal display during inverted operation of the liquid crystal display.

4 Claims, 7 Drawing Sheets

FIG.6

| $D_2$ | $D_1$ | $D_0$ | $V_{inv}$ | $V(n_1)$ | $V(n_2)$ | $V(n_3)$ | Vout |
|---|---|---|---|---|---|---|---|
| 0 | 0 | 0 | 0 | $V_1$ | $V_1$ | $V_1$ | $2Vref-V_1$ |
| 0 | 0 | 1 | 0 | $V_2$ | $V_1$ | $V_1$ | $2Vref-(6V_1+V_2)/7$ |
| 0 | 1 | 0 | 0 | $V_1$ | $V_2$ | $V_1$ | $2Vref-(5V_1+2V_2)/7$ |
| 0 | 1 | 1 | 0 | $V_2$ | $V_2$ | $V_1$ | $2Vref-(4V_1+3V_2)/7$ |
| 1 | 0 | 0 | 0 | $V_1$ | $V_1$ | $V_2$ | $2Vref-(3V_1+4V_2)/7$ |
| 1 | 0 | 1 | 0 | $V_2$ | $V_1$ | $V_2$ | $2Vref-(2V_1+5V_2)/7$ |
| 1 | 1 | 0 | 0 | $V_1$ | $V_2$ | $V_2$ | $2Vref-(V_1+6V_2)/7$ |
| 1 | 1 | 1 | 0 | $V_2$ | $V_2$ | $V_2$ | $2Vref-V_2$ |
| 0 | 0 | 0 | 1 | $V_2$ | $V_2$ | $V_2$ | $(4Vref-2Vx)-V_2$ |
| 0 | 0 | 1 | 1 | $V_1$ | $V_2$ | $V_2$ | $(4Vref-2Vx)-(6V_2+V_1)/7$ |
| 0 | 1 | 0 | 1 | $V_2$ | $V_1$ | $V_2$ | $(4Vref-2Vx)-(5V_2+2V_1)/7$ |
| 0 | 1 | 1 | 1 | $V_1$ | $V_1$ | $V_2$ | $(4Vref-2Vx)-(4V_2+3V_1)/7$ |
| 1 | 0 | 0 | 1 | $V_2$ | $V_2$ | $V_1$ | $(4Vref-2Vx)-(3V_2+4V_1)/7$ |
| 1 | 0 | 1 | 1 | $V_1$ | $V_2$ | $V_1$ | $(4Vref-2Vx)-(2V_2+5V_1)/7$ |
| 1 | 1 | 0 | 1 | $V_2$ | $V_1$ | $V_1$ | $(4Vref-2Vx)-(V_2+6V_1)/7$ |
| 1 | 1 | 1 | 1 | $V_1$ | $V_1$ | $V_1$ | $(4Vref-2Vx)-V_1$ |

DRIVING CIRCUIT FOR LIQUID CRYSTAL DISPLAY

BACKGROUND OF THE INVENTION

This invention relates to a liquid crystal display, more particularly to a circuit for driving a liquid crystal display, which can invert the drive signal of a liquid crystal panel by supplying inverted data voltage from a data driver to the liquid crystal panel without changing the common voltage.

In general, a liquid crystal display controls light transmissivity of liquid crystal by applying voltages that determine the lattice position of the liquid crystal. Positive (+) and negative (−) voltages are alternatively applied to increase the life time, of the liquid crystal because the lattice property can be degraded if voltage of only one polarity is applied. When the voltage applied to the pixel changes polarity, this is referred to as an inverted drive voltage.

FIG. 1 is a TFT(Thin Film Transistor) LCD(Liquid Crystal Display) panel.

The $Q_{ij}$(Q11, Q12, . . . ) shown in FIG. 1 represent TFT's driven by scan drivers.

The Cst's are storage capacitors which hold data voltage supplied from respective data drivers. Each $C_{LC}$ indicates a capacitance of the liquid crystal and represents the role of a liquid crystal. The liquid crystal, moved in a direction of the lattice proportional to a difference between the pixel node voltage $V_{ij}$(V11, V12, . . . ) and the common voltage Vcom, is arranged into a spiral form. When an inverted drive signal is applied, the liquid crystal twists in the opposite direction to form an "inverted" spiral. This voltage difference between the pixel node voltage $V_{ij}$(V11, V12, . . . ) and the common voltage Vcom determines a light transmissivity.

Each $Q_{ij}$, Cst, and $C_{LC}$ together acts as a pixel. A plurality of such pixels, arranged in an array, forms the liquid crystal panel.

The liquid crystal panel makes a frame of image by repeating a process in which, when the scan driver turns on rows of the liquid panel connected thereto one by one in sequence (thereby turning on the TFT's connected to each of the rows), the data driver applies data voltage to each of the pixels in the turned-on row according to the sequence, resulting in the data voltage being stored in each of the storage capacitors Cst in the row until the TFT's are turned on the next time.

The data drivers may be arranged on the upperside and the lowerside of the liquid crystal panel as shown in FIG. 1, or only on one side.

FIG. 2 shows voltage wave patterns showing, as an example, a conventional panel driving method and examples of data.

In FIG. 2, the SCLK is a basic clock of the scan driver, of which one basic clock period is a period during which one row of the liquid crystal panel remains turned on.

Voltage is applied to the rows of R1, R2, R3, . . . in sequence like V(R1), V(R2), V(R3), . . .

For the convenience of explanation, it is assumed that all of the color of the frame is identical, and the frame is formed by applying 2.5 V at both ends of the liquid crystal.

If voltages of Ci(C1, C2, . . . , Cm, . . . ) are applied like the V(Ci) shown in FIG. 2, the pixel node voltages $V_{ij}$ become V11, V21, . . . by operation of the scan driver for each of the pixels.

In the conventional liquid crystal display circuit, the data driver itself could not have applied inverted data voltage, but a voltage wave pattern at both ends of the liquid crystal is made to have an effect of being inverted like the V11−Vcom in FIG. 2 by alternating the common voltage Vcom as shown in FIG. 2.

In the meantime, though the pixel node voltage V11 in t2 section is identical to the data voltage V(C1), the pixel node voltage V11 in t3 section is slightly lower than original data voltage due to a ratio of the Cst to the $C_{LC}$ when TFT Q11 is turned off, dropping the common voltage Vcomm from 5 V to 0 V.

However, though the pixel node voltage V11 in t4 section becomes identical to the original data voltage again since the lowered amount of voltage in the t3 section is corrected, at the end, it can be seen that a voltage wave pattern V11−Vcom at both ends of the liquid crystal in a normal mode has a slight error voltage from original data voltage.

As has been explained, there is an error of voltage between an inverted mode and a normal mode of the conventional liquid crystal panel.

The common voltage Vcom connected to entire liquid crystal panel, which requires a large power for driving the panel, has been a great burden to an external circuit of the liquid crystal panel and inefficient in view of power consumption.

Though the best image can be obtained when the inversion operation is done by each of the pixel units, the conventional method has a disadvantage that the inversion operation can not but be done by frame unit.

SUMMARY OF THE INVENTION

The object of this invention devised for solving the foregoing problems is to provide a circuit for driving a liquid crystal display which can eliminate a voltage error between an inversion mode and a normal mode of the liquid crystal panel.

Other object of this invention is to provide a circuit for driving a liquid crystal display which is efficient in view of power consumption.

Another object of this invention is to provide a circuit for driving a liquid crystal display which is capable of inverted drives by pixel unit, row unit, and frame unit.

These and other objects and features of this invention can be achieved by providing a circuit for driving a liquid crystal display including an inverted voltage supplying part which can supply additional inversion power to the liquid crystal display inverted driving of the liquid crystal panel.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not, limitative of the present invention.

FIG. 6 is a table of logic of an S/W block part in accordance with this invention.

DETAILED DESCRIPTION OF THE PREFERRED EMBODIMENTS

Figure 3:
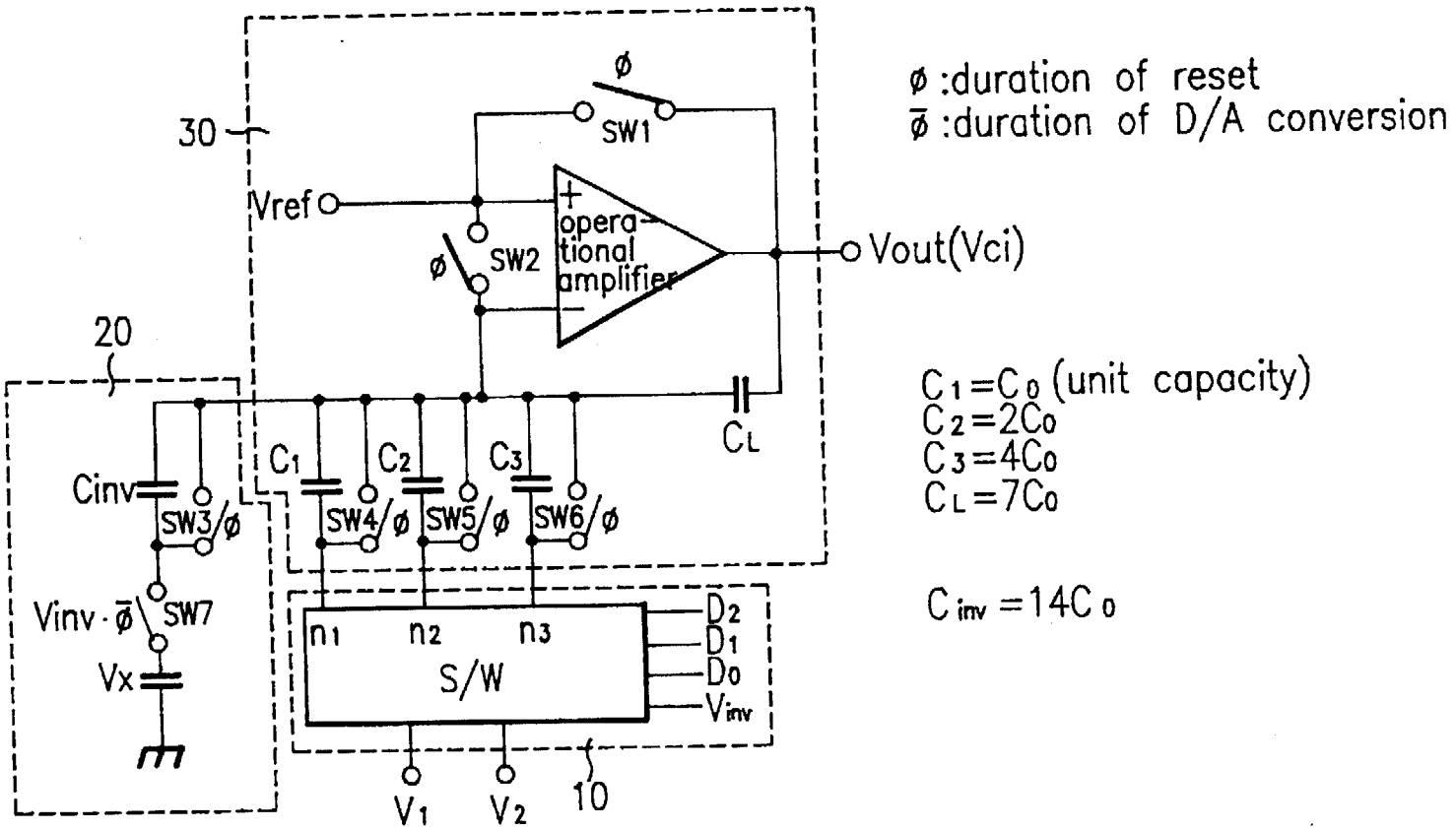
FIG. 3 shows a circuit for driving a liquid crystal display in accordance with this invention.

System and operation of the preferred embodiment of this invention is to be explained in detail, referring to FIGS. 3 and 6.

FIG. 3 shows a driving circuit of a liquid crystal display in accordance with this invention.

Figure 4:
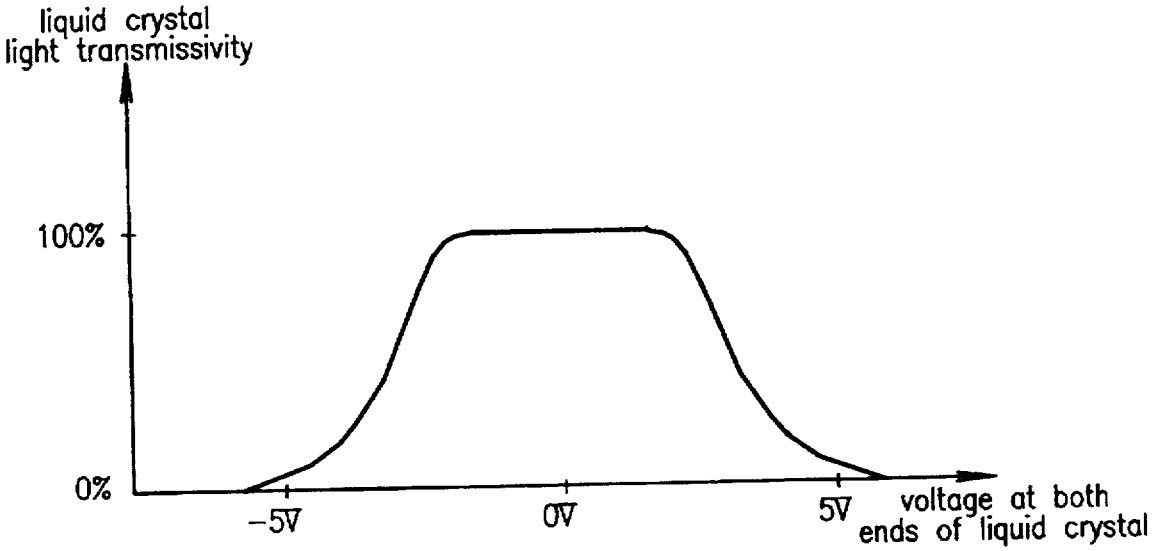
FIG. 4 is a graph showing light transmissivity of an LCD.

FIG. 4 is a graph showing light transmissivity of the liquid crystal display.

FIG. 5 shows voltage wave patterns showing, as an example, a panel driving method and examples of data on the liquid crystal display panel in accordance with this invention.

The driving circuit of the liquid crystal display in accordance with this invention includes a switch block part 10 for selective application of the voltages V1 and V2 to the nodes of n1, n2, and n3 according to received data $D_0$, $D_1$, $D_2$ and $V_{inv}$ an inversion voltage supplying supplemental part 20 for supplying inverted data voltage to a liquid crystal panel during inverted driving of the liquid crystal panel, and a D/A conversion part 30 for converting digital data received from the switch block part 10 into analog data.

The inversion voltage supplying part 20 being a principal part of this invention, includes an inversion control capacitor Cinv, an inversion power source Vx connected to the inversion control capacitor Cinv having a minus terminal thereof connected to ground, a switch SW7 connected between the inversion control capacitor Cinv and the inversion power source Vx for being turned on for supplying the inversion power Vx to the liquid crystal panel only at inverted driving of the liquid crystal panel, and a switch SW3 connected in parallel to the inversion control capacitor Cinv for equalizing voltage at both ends of the inversion control capacitor Cinv.

This invention is to be explained in more detail, referring to FIGS. 3 and 6.

FIG. 6 is a logic table of the S/W block part in accordance with this invention.

The SW block part 10 is operated according to the logic table in FIG. 6.

That is, when the inversion control voltage of the S/W block part 10 is Vinv=0, i.e., the liquid crystal panel is under normal operation, all the nodes of n1, n2, and n3 will have a voltage of V1 applied thereto if the received data D2, D1, and Do are "0, 0, 0". The nodes of n1, n2, and n3 will have voltages of V1 and V2 applied thereto, as shown in FIG. 6, as the received data D2, D1, and Do change.

According to the principle of conservation of charge, the D/A conversion equation in this case of normal operation is as follows.

$$Vout=[1+(C1+C2+C3)/C_L]Vref-C1/C_L\cdot Vn1-C2/C_L\cdot Vn2-C3/C_L\cdot Vn3.$$

According to above equation, output voltages as shown in the logic table of FIG. 6 are obtained.

In the meantime, when the inversion control voltage of the S/W block part 10 is Vinv=1, i.e., the liquid crystal panel is under inverted operation, all of the nodes of n1, n2, and n3 will have a voltage of V2 applied thereto if the input data D2, D1, and Do are "0, 0, 0".

And, if V1=5 V and V2=0 V, with increase of the output voltage Vout from 0 V to 5 V as the digital data becomes greater at normal operation(Vinv=0) of the liquid crystal panel, and with decrease of the output voltage Vout from 10 V to 5 V as the digital data becomes greater at inverted operation(Vinv=1) of the liquid crystal panel, the liquid crystal panel is operable according to an inversion function meeting the LCD light transmissivity property of FIG. 4.

The D/A conversion equation in this case of inverted operation is as follows.

$$Vout=[1+(C1+C2+C3+Cinv)/C_L]Vref-C1/C_L\cdot Vn1-C2/C_L\cdot Vn2-C3/C_L\cdot Vn3-Cinv/C_L\cdot Vx.$$

With the C1=Co, C2=2Co, C3=4Co, $C_L$=7Co, and Cinv=14Co, the output voltage of this embodiment in the inverted mode is greater than the output voltage in the normal mode by $Cinv/C_L\cdot(Vref-Vx)$.

In the circuitry illustration of FIG. 3, the $\phi$ is a duration for a D/A conversion, i.e., a duration of reset of the charge in the capacitor at normal operation of the liquid crystal panel.

The $\bar{\phi}$ is a duration for a D/A conversion at inverted driving of the liquid crystal panel. The $\phi$ and $\bar{\phi}$ are durations which do not overlap.

It can be seen from FIG. 4 that the LCD light transmissivity is 100%, when voltage at both ends of the liquid crystal is in a range of $-2.5\ V \leqq V11-Vcom \leqq 2.5\ V$.

Figure 1:
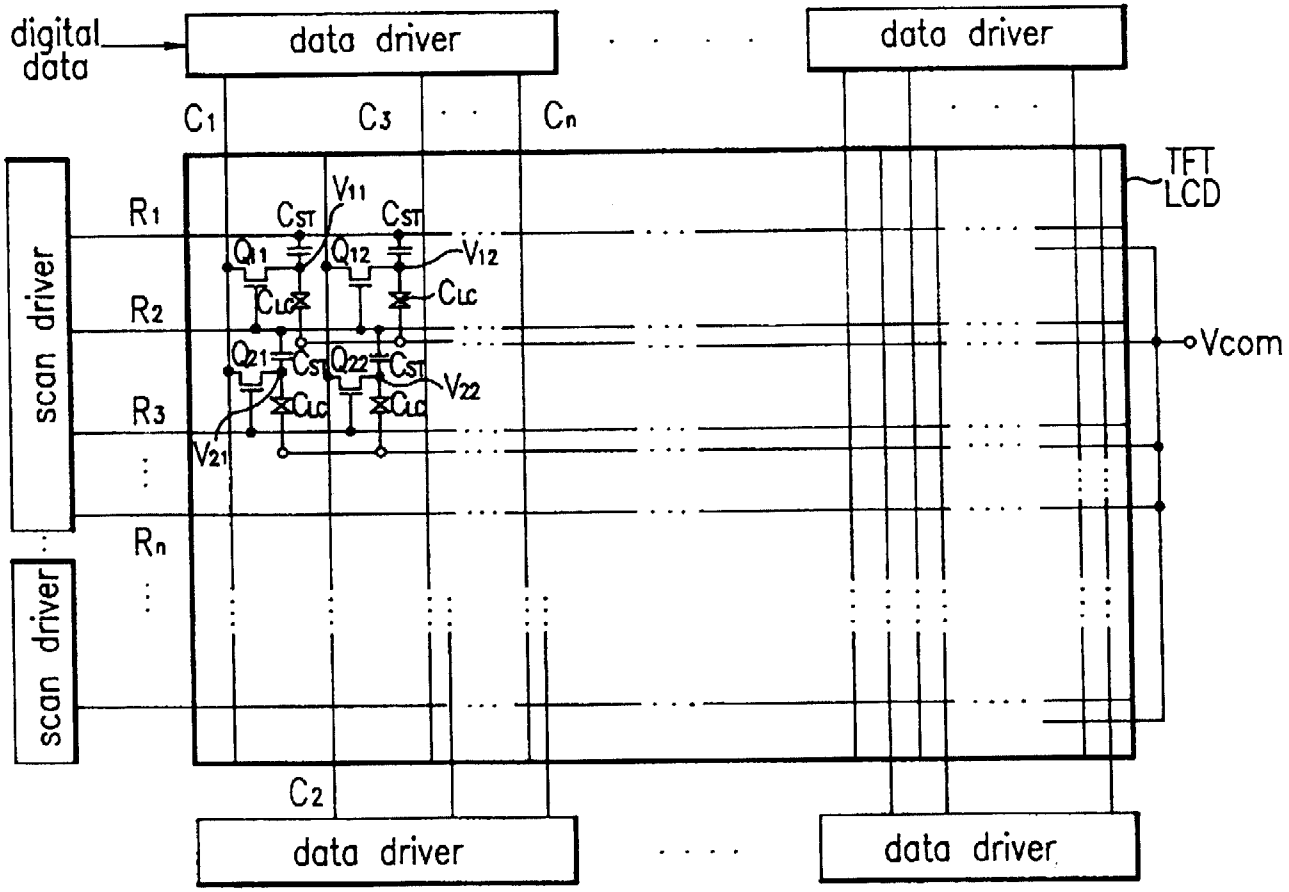
FIG. 1 is a schematic illustration of a TFT LCD panel system.
Figure 2:
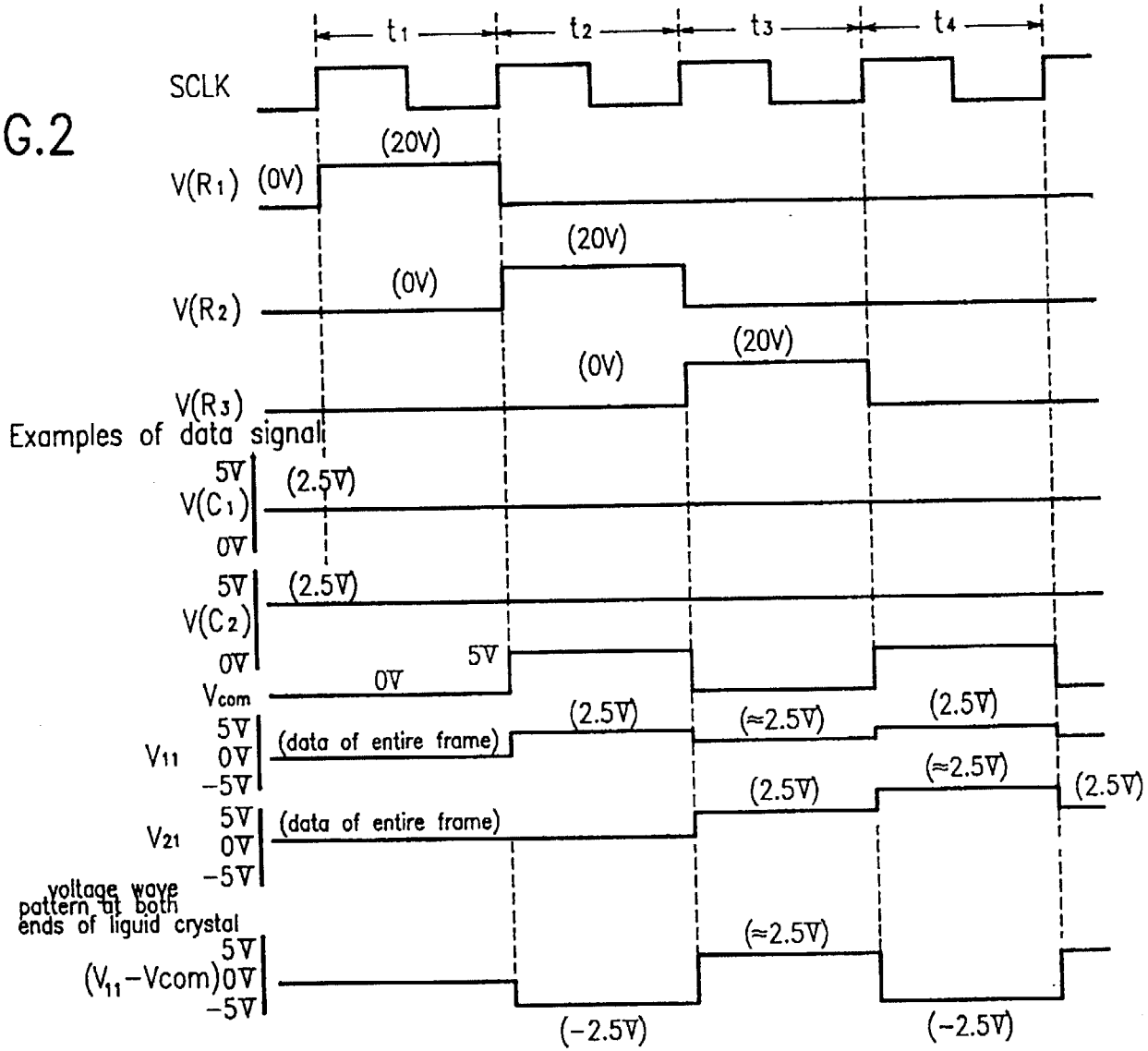
FIG. 2 shows voltage wave patterns showing, as an example, a conventional panel driving method and examples of data.

Referring to FIGS. 1 and 5, a method for operating the liquid crystal panel is to be explained in detail.

Figures 5A, 5B, 5C, 5D, 5E, 5F:
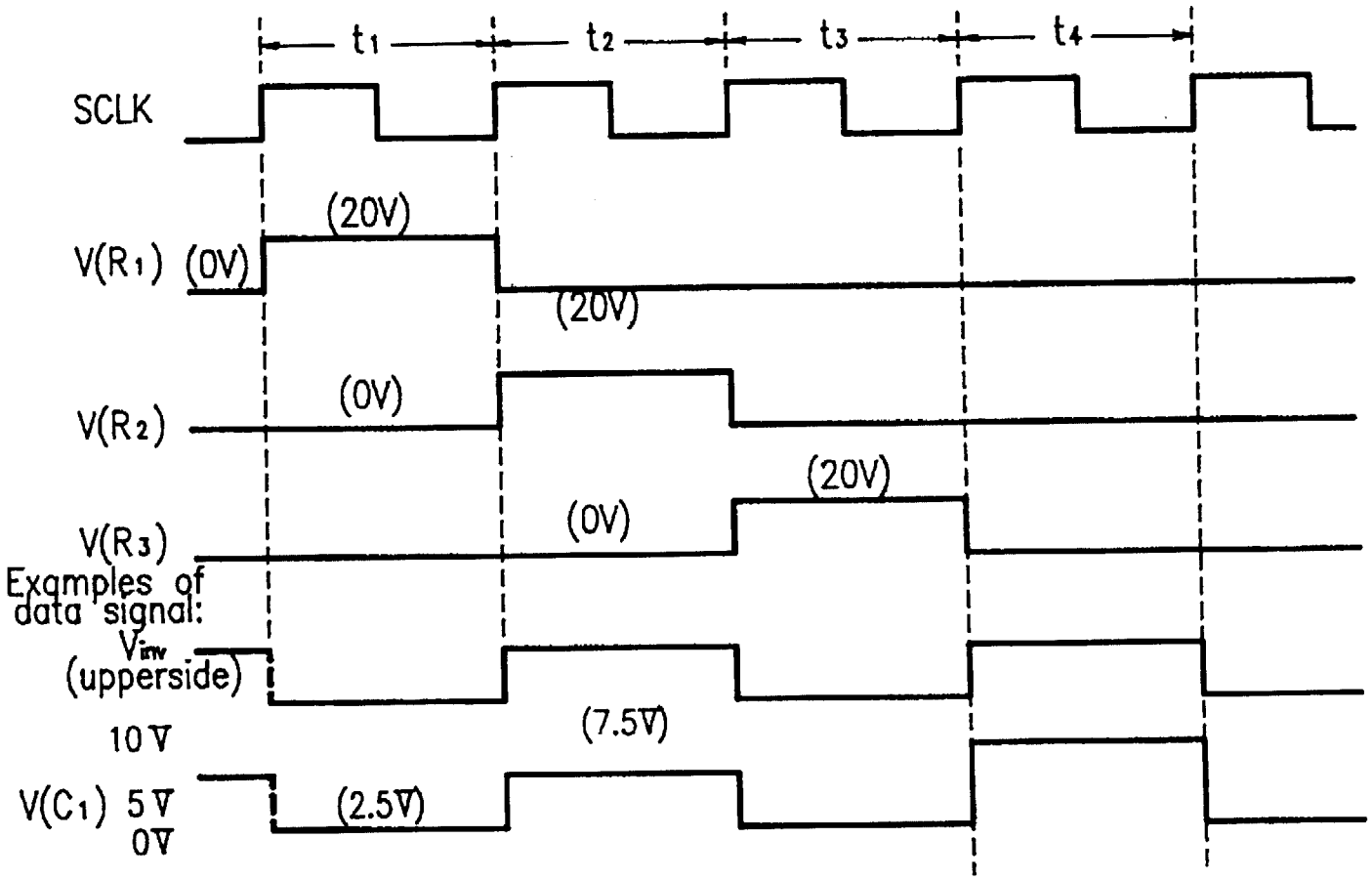
FIGS. 5*a* to 5*m* show voltage wave patterns showing, as an example, a panel driving method and examples of data on the liquid crystal display panel in accordance with this invention.

First, at normal operation of the liquid crystal panel, when a clock pulse signal as shown in FIG. 5*a* is applied to the rows of R1, R2, R3, . . . , Rn, . . . of the liquid crystal panel in sequence, signal wave patterns of V(R1), V(R2), V(R3), . . . , V(Rn), . . . as shown in FIG. 5*b*, 5*c*, and 5*d* are applied to each of the rows in sequence.

Thus, the TFT's connected to the rows are turned on.

At corresponding times, voltages for the pixels, i.e., data voltages for the row, are applied from the data driver to the storage capacitor to be stored therein, which data voltages are kept stored therein until the TFT is turned on the next time.

When an inversion control wave pattern $V_{inv}$ as shown in FIG. 5*e* is applied to the data driver at the upper part of FIG. 1, a data voltage wave pattern V(C1) as shown in FIG. 5*f* is applied to the corresponding row of the liquid crystal panel. When an inversion control wave pattern as shown in FIG. 5*g* is applied to the data driver at lower part of FIG. 1, a data voltage wave pattern V(C2) as shown in FIG. 5*h* is applied to the corresponding row of the liquid crystal panel.

Figures 5G, 5H, 5I, 5J, 5K, 5L, 5M:
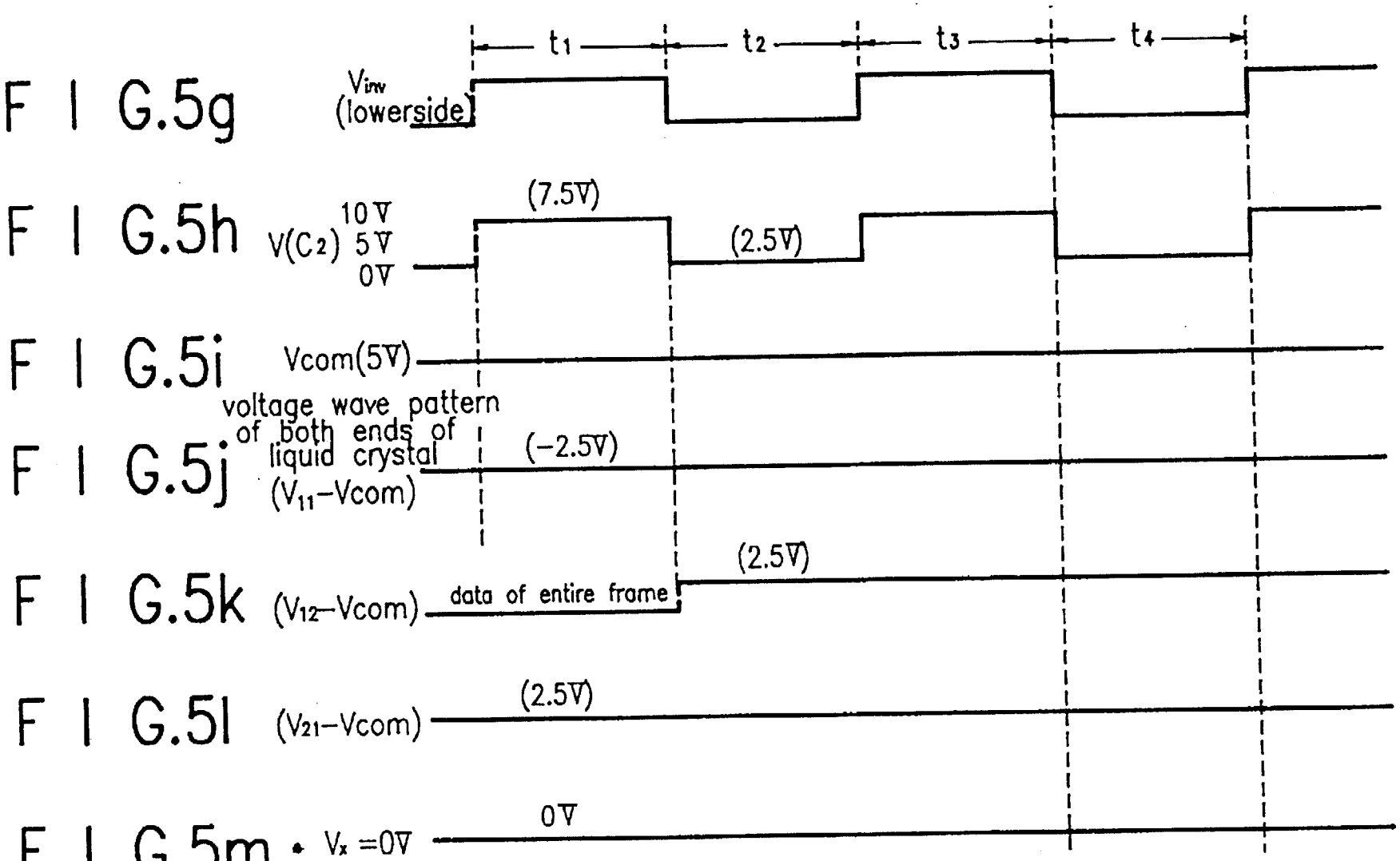

In the meantime, the common voltage Vcom applied to all of the liquid crystal panel is maintained constant at 5 V as shown in FIG. 5*i*.

Accordingly, the voltage wave patterns of V11−Vcom, V12−Vcom, V21−Vcom, . . . are obtained as shown in FIGS. 5*j*, 5*k*, and 5*l*, respectively.

At the end, when the liquid crystal panel is operated as has been explained, a good quality picture is obtainable, because inverted control classified by each of the pixels is made available, since V11 and V12, and V11 and V21 become inverted to the other, and because all of row inversion and frame inversion are made available, since the inversion control voltage Vinv is controlled by frame unit.

As another embodiment of this invention, the inverted driving of the liquid crystal panel through inverting direction of the D/A conversion by the S/W block part 10 can be made available by using $\overline{D}o$, $\overline{D}1$, and $\overline{D}2$ instead of using Do, D1, and D2.

This invention having the foregoing system has following advantages.

First, by direct application of inverted voltage from the data drivers, and by application of the DC power of 5 V as the common voltage, inversion classified by pixel is made available, and accordingly a good quality picture is obtainable, and by controlling the inversion control voltage, row inversion as well as frame inversion are made available.

Second, by making inverted operation of the liquid crystal panel with direct application of the inverted data voltage to the liquid crystal panel, a difference of voltages between the inversion mode and the normal mode can be eliminated compared to the conventional case when the inversion control is made with the common voltage, and power consumption can be efficient since no substantial burden is put on the external circuit of the liquid crystal panel and unnecessary voltages are not applied to the liquid crystal panel.

Third, the system of the liquid crystal panel can be simplified by making the common voltage constant since no external circuit to the liquid crystal panel is required.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A circuit for driving a liquid crystal display comprising:

mode driving means for supplying first polarity driving voltages to the liquid crystal display during a normal mode and supplying second polarity voltages opposite to the first polarity during an inverted mode; and a supplemental voltage supplying circuit supplying supplemental inverted power to the liquid crystal display during the inverted mode to ensure substantial equivalence in magnitude between corresponding first polarity voltages and second polarity voltages applied across;

wherein the supplemental voltage supplying circuit includes, an inversion control capacitor, an inversion power source having a plus terminal thereof connected to the inversion control capacitor in series and a minus terminal thereof connected to ground, a switch provided between the inversion control capacitor and the inversion power source for selectively supplying the inversion power to the liquid crystal display only during the inverted drive signal mode of the liquid crystal display, and a switch connected in parallel with the inversion control capacitor for being turned on only at normal operation of the liquid crystal panel for equalizing voltage at both ends of the inversion control capacitor.

2. The circuit as in claim 1, wherein a common mode voltage on the liquid crystal display is held at a constant value.

3. The circuit as in claim 2, wherein the common mode voltage is held at five volts.

4. The circuit as in claim 1, wherein the mode driving means includes:

switch block means, having three outputs, for selectively applying two input voltages V1 and V2 to the three outputs according to a plurality of switch block control signals; and amplification means for amplifying a combined signal of the three outputs of the switch block means and supplying the amplified combination to the liquid crystal display.

* * * * *